United States Patent [19]

Sladky

[11] Patent Number: 4,799,542

[45] Date of Patent: Jan. 24, 1989

[54] HEAT EXCHANGER WITH THIN-FILM EVAPORATOR

[76] Inventor: Hans Sladky, Wischhofstrasse 7, D-2000 Hamburg 65, Fed. Rep. of Germany

[21] Appl. No.: 892,947

[22] Filed: Aug. 4, 1986

Related U.S. Application Data

[63] Continuation-in-part of Ser. No. 628,017, Jul. 5, 1984, abandoned.

[30] Foreign Application Priority Data

Jul. 6, 1983 [DE] Fed. Rep. of Germany ..... 3324330

[51] Int. Cl.[4] ..... F28D 3/02

[52] U.S. Cl. ..... 165/118; 159/13.2; 62/123

[58] Field of Search ..... 62/123; 165/115, 118; 159/13.1, 13.2; 239/590, 590.5

[56] References Cited

U.S. PATENT DOCUMENTS

| | | | |
|---|---|---|---|
| 3,371,709 | 3/1968 | Rosenblad | 165/115 |
| 3,524,729 | 8/1970 | Markel et al. | 165/115 X |
| 4,572,287 | 2/1986 | Allo et al. | 165/118 |

FOREIGN PATENT DOCUMENTS

| | | | |
|---|---|---|---|
| 0131213 | 6/1984 | European Pat. Off. | 165/118 |
| 46722 | 6/1966 | Fed. Rep. of Germany | 165/115 |
| 1458492 | 12/1976 | United Kingdom | 165/118 |

*Primary Examiner*—Albert W. Davis, Jr.

*Assistant Examiner*—Peggy Neils

*Attorney, Agent, or Firm*—Karl F. Ross

[57] ABSTRACT

A heat exchanger designed to cool a liquid such as water has a boiler with several upright heat-transfer tubes on whose inner surfaces the liquid descends in the form of a thin film while a refrigerant such as ammonia or a Freon rises within the boiler. To generate the thin films the liquid to be cooled is collected in a storage vessel above the boiler into which the heat-transfer tubes project. Each of these open-topped tubes contains an insert with a frustoconically diverging bottom part approaching the inner tube surface to within a fraction of a millimeter. The bottom part of the insert has an acute-angled peripheral edge insuring the detachment of the liquid from its surface. The several inserts are suspended from a vertically reciprocable piston rod forming part of a pneumatic jack whose alternate pressurization is controlled by a relay in response to two microswitches actuated by cams on the piston rod and to two level sensors ascertaining the liquid level in the storage vessel. A rise in the liquid level detected by the first sensor, due to a clogging of the annular gap by solids present in the liquid to be cooled, initiates such vertical reciprocation; if that fails to dislodge the accumulated solids, as determined by a further rise in liquid level detected by the second sensor, the inserts are fully extracted from their tubes so that also larger chunks can be swept away, causing the liquid volume to decrease to a normal amount.

11 Claims, 7 Drawing Sheets

HEAT EXCHANGER WITH THIN-FILM EVAPORATOR

CROSS REFERENCE TO RELATED APPLICATION

This application is a continuation in part of Ser. No. 628,017 filed July 5, 1984 now abandoned.

FIELD OF THE INVENTION

My present invention relates to a heat exchanger utilizing an evaporator of the thin-film type in which a liquid to be cooled descends along the inner surface of an upright heat-transfer tube whose outer surface is in contact with a vaporizable refrigerant, such as ammonia or a Freon, passing (generally in an upright direction) through a boiler surrounding that tube.

BACKGROUND OF THE INVENTION

Conventional evaporators with horizontal tubes traversed by the liquid to be cooled and covered by refrigerant, specifically $CCl_2F_2$ (Freon 12), have a maximum heat-transfer coefficient of about 400 $W/m^2K$. If the liquid is water, the cooling must not be carried below +4° C. in order to avoid a bursting of the tubes by ice formation. The tubes can be cleaned only after removal of a tightly fitting distributing collar.

When the liquid to be cooled, e.g. water, forms a pool in which upright tubes traversed by the refrigerant are disposed, the minimum temperature can be about +1° C. but the arrangement requires considerably more space. The heat-transfer coefficient is reduced in that case to about 300 $W/m^2K$. The same is true when the tubes are replaced by evaporator plates. The cleaning of the outer surfaces of the tubes or the plates is complicated since they are generally immersed to a depth of up to 1.5 m in the liquid with a maximum spacing of about 100 mm.

The best heat-transfer coefficients of about 800$W/m^2K$ and lowest temperature limit of about +0.2° C. are obtainable with thin-film tube or plate coolers, i.e. horizontal tubes or plates traversed by the refrigerant and covered by a laminar flow of the liquid. For this purpose it is necessary to let the liquid drip onto the tubes or plates through narrow perforations of an overlying distributing plate; these perforations are readily clogged by any solids entrained by the liquid. Cleaning these surfaces again requires considerable work and an interruption of the operation since the flow-confining sidewalls will have to be removed first.

It has already been proposed to provide a heat exchanger with upright heat-transfer tubes along whose inner surfaces a liquid passes downward in the form of a film while the outer tube surfaces are in contact with another fluid. As far as I am aware, however, such systems have not been successful in practice on account of the problems of insuring a laminar liquid flow along the inner tube surfaces. German printed specification (Auslegeschrift) No. 11 64 990, for example, proposes the use of an annular barrier or weir surrounding an upper entrance end of each tube which, however, does not insure the overall and continuous adherence of the liquid flow to the inner tube surfaces. Nor is such adherence guaranteed by an arrangement such as that of Swiss patent No. 600,279 according to which the liquid enters each tube tangentially via several coplanar conduits.

East German (G.D.R.) patent No. 46,722 discloses the provision of a trumpet-shaped distributor pipe which enters the heat-transfer tube from above and has a downwardly diverging bottom part and a flat lower edge separated from the inner tube surface by an annular gap which is interrupted by several spacing ribs. While no dimensions for that gap are given in the patent, its drawing shows the gap width to be about equal to the width of the bottom edge and thus to the wall thickness of the distributor pipe. This arrangement again does not invariably establish the desired type of flow discussed above; I have found, in fact, that the descending liquid tends to adhere to the edge of the pipe so that a significant portion thereof does not even reach the surrounding tube wall but drops free through its interior. With the configuration referred to, even a considerable narrowing of the gap will not bring a significant improvement in that respect.

Furthermore, the presence of a narrow gap between a heat-transfer tube and an inserted distributor body gives rise to an additional problem, namely a clogging of the gap by solids which may be entrained by the liquid to be cooled. In many instances, especially in industrial plants, it is convenient to use river or ground water as that liquid, i.e. as a source of heat to be extracted by the refrigerant and transmitted by the latter via another heat exchanger to a load. The liquid itself, of course, could be used as a coolant for various pieces of machinery after having been brought to a low temperature by heat exchange with the refrigerant.

OBJECTS OF THE INVENTION

An important object of my present invention, therefore, is to provide an improved evaporator for a heat exchanger having means for insuring the descent of a liquid along an inner wall surface of an upright transfer tube as a thin film fully adhering so that surface in order to make available the advantages of compact structure and high transfer coefficient of such an arrangement.

A more particular object is to provide means in such a heat exchanger for clearing an annular gap thereof from flow-obstructing solids without the need for an intervention by an operator.

Yet another object of this invention is to advance the principles set forth in my above-identified copending application.

It is yet another object of this invention to provide an improved transfer-tube assembly which is of inexpensive manufacture, can be readily assembled to permit thin-film heat transfer under selected conditions and is of simplified construction with respect to the film-forming insert used.

SUMMARY OF THE INVENTION

I have found, in accordance with my present invention, that the desired thin film on the inside of a heat-transfer tube can be reliably generated by providing that tube with an insert suspended from above into same, that insert having a solid bottom part which divergingly approaches the inner tube periphery along a narrow annular gap bounded by an acute-angled peripheral edge that is defined by a downwardly open recess of the solid bottom part, there being further provided a storage vessel for the liquid disposed above the boiler surrounding the tube and in communication with an upper entrance end of the tube for letting the liquid flow down through the annular gap as a thin film hugging its inner periphery.

The acute angle of the bottom edge of the insert, which I have found essential for a safe detachment of the liquid from that insert, generally calls for an angle of at least 30° included between the generatrices of the bottom recess and the horizontal. Preferably, this angle ranges between about 45° and 60° whereby, when that bottom part diverges with a vertex angle on the order of 10°, the acute angle at the edge will lie between substantially 20° and 40°.

The width of the annular gap separating the insert from the tube wall ought to be not more than about 1 mm, preferably ranging between substantially 0.3 and 0.7 mm.

Since the entirely or partly solid insert prevents the entry of atmospheric air into the heat-transfer tube, and since the overlying storage vessel can also be sealed against the atmosphere, my improved system can be used for the refrigeration of a liquid such as milk which ought not to be exposed to possible contamination before being filled into bottles. In the case of water, I have found that supercooling below 0° C.—e.g. to about $-\frac{1}{2}$° C.—is entirely possible.

When a solids-laden liquid such as ground or river water is to serve as a heat source as discussed above, clogging of the annular gap cannot be avoided. However, in accordance with another important feature of my invention, I make the suspended insert vertically reciprocable within its tube for the purpose of dislodging such solids when their presence is detected. In the best mode of the invention, the cleaning process is triggered and its duration controlled by a time switch. While such reciprocation could be carried out also manually, I can provide automatic means for this purpose, e.g. sensing means in the storage vessel for detecting a rise in the liquid level above a predetermined limit as an indication of gap clogging and servo means responsive to the sensing means for reciprocating the insert within its tube until the liquid level returns to normal. This presupposes, of course, that the liquid is continuously fed to the storage vessel by suitable supply means at a steady rate commensurate with its normal runoff through the gap.

Advantageously, pursuant to yet another feature of my invention, the sensing means referred to include a first sensor for detecting a rise of the liquid level above a first limit and a second sensor for detecting a further rise above a second limit, the servo means being responsive to the first sensor for reciprocating the insert within its tube and being further responsive to the second sensor for completely lifting the insert out of the tube to enable dislodgment of larger chunks of solids through the tube if the reciprocating mode of operation has not resulted in a restoration of normal flow.

The refrigerant, being a valuable substance, is generally recycled through the boiler by way of a compressor and a condenser. For optimum efficiency, especially when the condenser is also used to heat up a load, it is desirable to let only vapor from the top of the boiler enter the compressor and to return only liquid refrigerant to the bottom of the boiler. A further feature of my invention, therefore, resides in the provision of an effective phase separator in circuit with the compressor and the condenser, this separator communicating with both an upper exit end of the boiler and a lower entrance end thereof. According to this aspect of my invention, the phase separator advantageously comprises a horizontally elongate container with opposite end walls one of which is traversed by a horizontal injection pipe terminating in a discharge port of the condenser so as to carry mostly reliquefied refrigerant, this pipe being spacedly surrounded by a sleeve having a closed end confronting the first-mentioned end wall and an open end confronting the other end wall. The interior of the sleeve communicates with the upper exit end of the boiler from which it receives, preferably via a pair of upwardly sloping overflow conduits, a mixture of vaporized and still liquid refrigerant entrained by the injected fluid through the open end of the sleeve whence all the vapors pass through a top outlet near the first end wall to a suction port of the compressor while the liquid accumulates at the bottom for recirculation by way of a drain to the lower entrance end of the boiler.

It will be understood that the features described above with reference to a single heat-transfer tube will also be applicable to a group of such tubes received in a common boiler and overlain by a common storage vessel.

According to another feature of the invention, the insert in the upper end of the tube comprises an injection-molded synthetic resin body formed at its lower end with an outwardly divergent hollow frustoconical portion a lower edge of which is juxtaposed with the inner will of the pipe across the aforementioned narrow annular gap and which can be formed by an internal bevel at this lower edge. The bevel, while located along the interior of the frustoconical portion and seemingly incapable of affecting the film, appears to contribute significantly to both the uniformity and reproducibility of the film which can be generated, possibly by eliminating Coanda-type adhesion flows inwardly at the lower edge.

A plurality, preferably at least three and most desirably four, angularly equispaced, axially extending guide webs lying in respective axial planes and integrally formed on said frustoconical portion serve to position the frustoconical portion in the metal tube, at least the lower ends of these guide webs slidably engaging the inner surface of the metal tube in which the injection-molded synthetic resin body is fitted. These webs can extend the full length of the frustoconical portion and can be of decreasing radial height downwards, virtually disappearing at the edge.

Advantageously the body is extended upwardly by a cylindrical shank molded integrally with the frustoconical portion and with the aforementioned webs, the latter being of constant radial height where they extend from the shank. A portion of the shank can project upwardly beyond the webs to facilitate gripping for insertion and removal and to have a groove in which a C-clip can engage.

According to yet another feature of the invention, the assembly comprises a sleeve of extruded or injection molded synthetic resin which fits snugly on the metal tube, has an internal shoulder abutting the upper end of the metal tube and thereby establishing the depth to which the metal tube extends into the sleeve, and is engaged above the tube by the aforementioned webs. The latter can be stepped so that their lower portions have radial distances from the common axis of the assembly equal to the radius of the metal tube. At the junction between the lower portion and upper portion of each web a step can be formed which engages on the aforementioned shoulder and/or tube end to accurately position the body in the plastic sleeve.

Surprisingly, in spite of the presence of the guide webs, which could be considered to be partitions subdividing the flow into a number of sectors, the uniformity of the film is unaffected, while the webs contribute significantly to the precision of the gap and hence the critical film thickness, which remains uniform over the entire inner periphery of the pipe. Fabrication is simplified by the use of the plastic sleeve to hold the insert since both are easily mounted on the pipe and maintain the precision of the gap.

It is important to observe that the system of the invention controls the flow rate through the gap, once the latter is fixed by the dimensions of the insert and the pipe, exclusively in dependence upon the static pressure or head of water in the upper chamber, i.e. above the gap. The complete filling of the space above the gap with water ensures that the water film will be homogeneous, since heterogeneity contributed by air entrainment is excluded.

Finally I can mention that the gap dimensions can be easily selected for a particular heat exchange application by simply rolling the upper end of the tube to a suitable inner diameter, and then applying the sleeve in which the insert is accurately held by the guide webs or ribs.

BRIEF DESCRIPTION OF THE DRAWING

The above and other features of my invention will now be described in detail with reference to the accompanying drawing in which.

SPECIFIC DESCRIPTION

Figure 1:
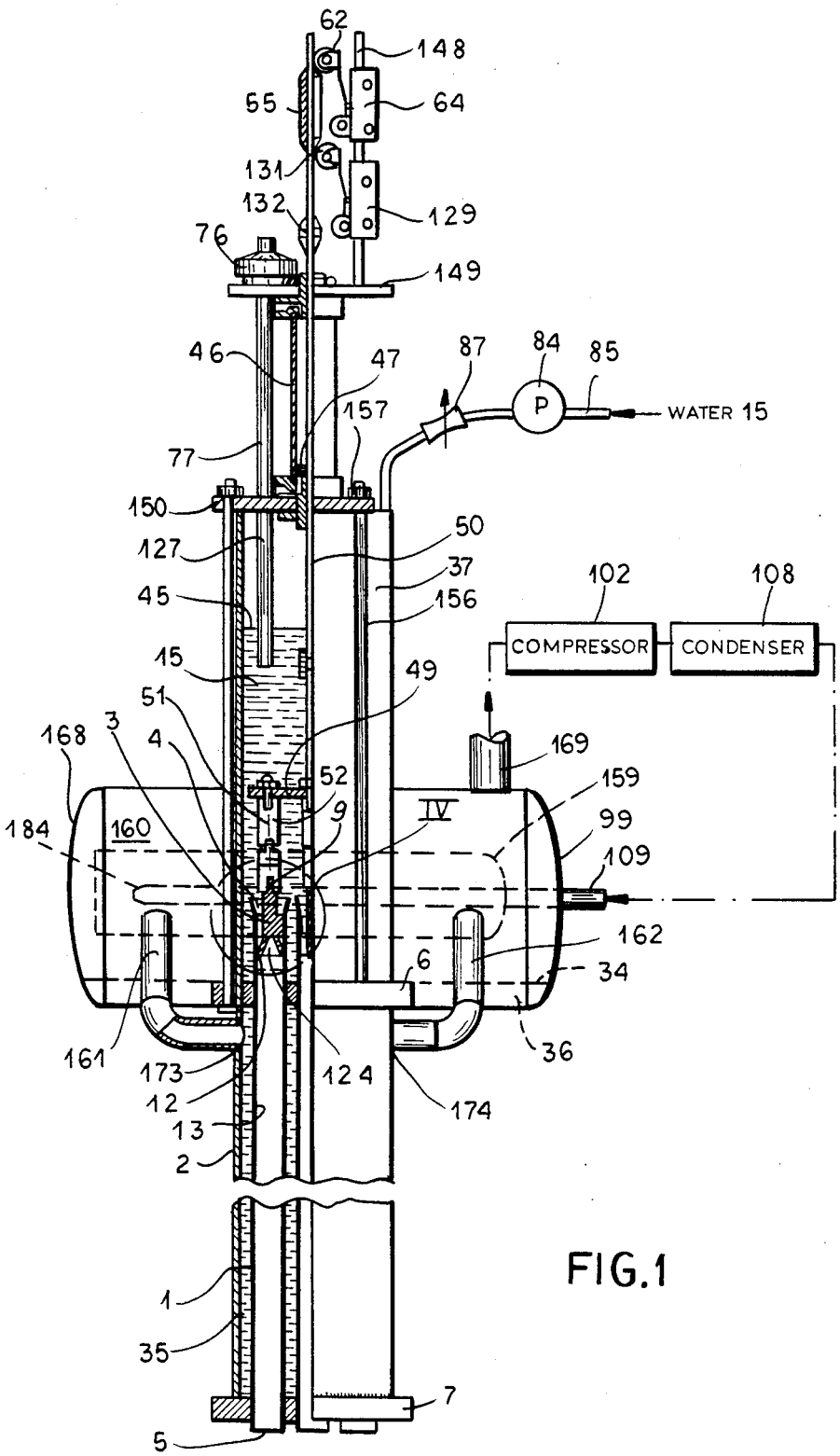
FIG. 1 is an elevational view, partly in section and somewhat diagrammatic, of a heat exchanger embodying my invention.
Figure 2:
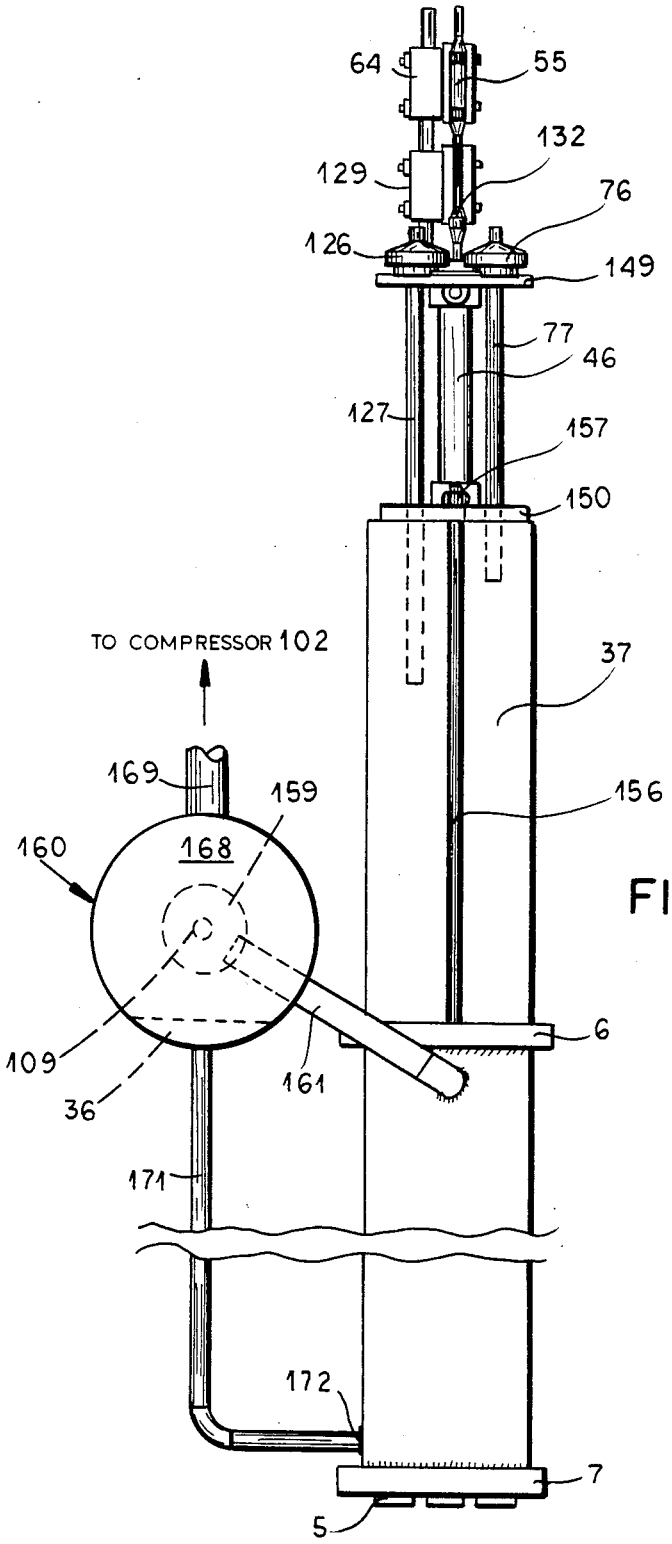
FIG. 2 is an elevational view taken at right angles to that of FIG. 1.
Figure 3:
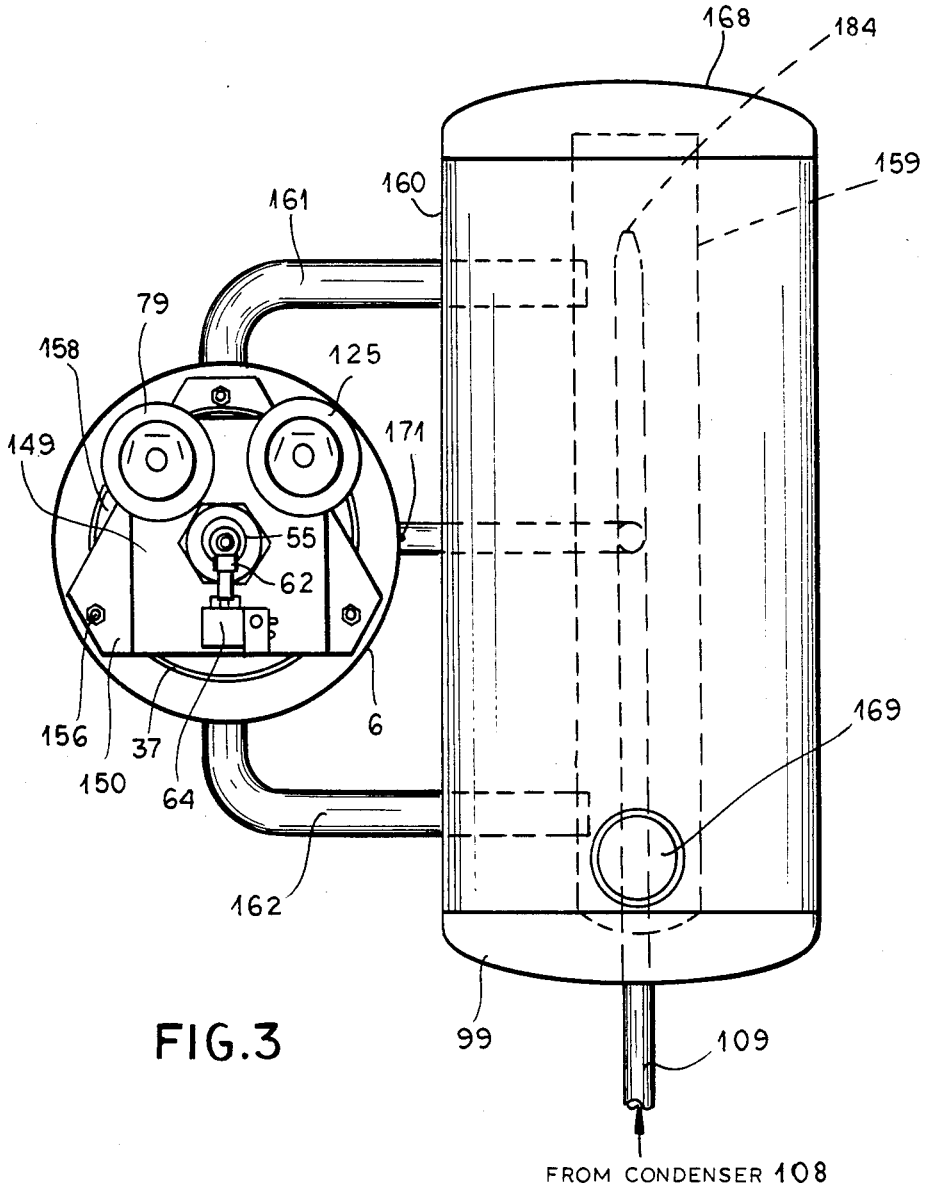
FIG. 3 is a top view of the assembly of FIGS. 1 and 2.

In FIGS. 1–3 I have shown a heat exchanger comprising an evaporator including a boiler 2, centered on a vertical axis, and a phase separator 160 with a horizontal axis lying skew to that of the boiler above the top thereof. Boiler 2 is vertically traversed by a number of heat-transfer tubes 1 projecting through a cover plate 6 thereof into an overlying storage vessel 37 of the same diameter. Water 15, which may contain some sludge, is continuously fed to vessel 37 through a supply pipe 85 by means of a pump 84 and at a constant rate determined by the setting of a throttle valve 87. Within that vessel, the water accumulates to a level 45 which will always lie above the upwardly diverging entrance ends 4 of tubes 1 so that some of it can descend within each tube along an inner wall surface 13 thereof to its lower end 5 projecting from a bottom plate 7. The top portion of each tube 1 is partly obstructed by an insert 3, better illustrated in FIGS. 4 and 6, whose neck 9 is connected by a link 52 (FIG. 1) or directly (FIG. 6) with a perforated plate 49 suspended from a piston rod 50 of a fluidic jack 46 provided with a piston head 47. Each link 52 is shown provided with a universal joint 51 to prevent possible jamming. The perforations 48 of plate 49 (FIG. 7) enable free passage of the water 15 through that plate.

Each insert 3 is shown (FIG. 4) to have an upper part 18 and a lower part 19, both solid, the lower part 19 having its bottom formed with a conical recess 124 whose cross-section is here seen to be an equilateral triangle so that its generatrices include an angle of 60° with the horizontal. The outer surface of part 19 is frustoconical, diverging downward at a vertex angle of approximately 10° so as to define with recess 124 a circular edge 12 with an acute rake angle of about 25° in this instance. As noted above, the preferred upper limit for this rake angle is substantially 45°.

Edge 12 defines with the inner wall surface 23 of tube 1 an annular gap 14 a fraction of a millimeter in width. Liquid flowing from storage vessel 37 (FIGS. 1 and 2) into the entrance end 4 of the tube passes the gap 14 as a thin film 16 (FIG. 10) readily detaching itself from insert 3 while adhering to surface 13 until it leaves the tube at its bottom end 5. In reaching the gap, the liquid flows through three channels 23, 24, 25 (see FIG. 5) bounded by radially extending guide ribs 20, 21, 22 of upper part 18 whose rounded edges are in close contact with surface 13. Part 18 terminates in a triangular upper plate 18' by which it rests on the entrance end 4 of tube 1 in the normal position illustrated in FIG. 4.

Figure 6:
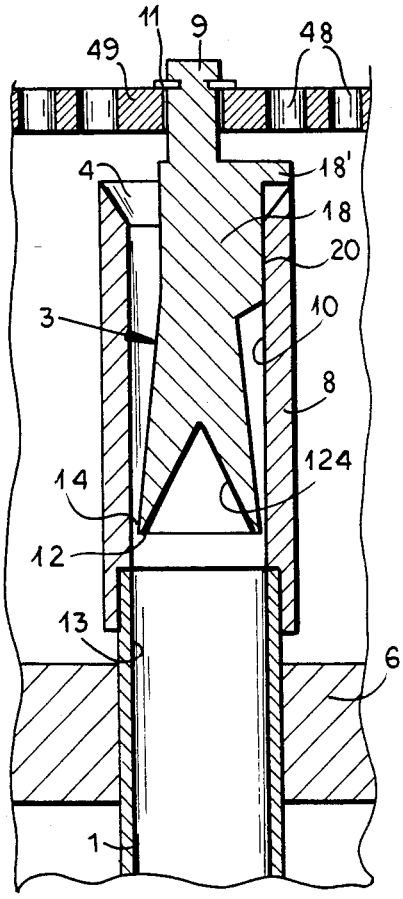
FIG. 6 is a sectional view similar to FIG. 4, taken on the line VI—VI of FIG. 7 to illustrate a modification.

For more secure guidance of insert 3, the top portion of the relatively thin-walled tube 1 may be replaced by a detachable extension 8 of greater wall thickness, as shown in FIG. 6, whose inner peripheral surface 10 is flush with surface 13 of tube 1.

Figure 7:
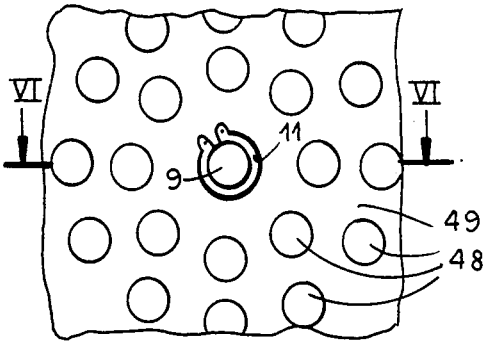
FIG. 7 is a top view of the arrangement of FIG. 6.
Figure 5:
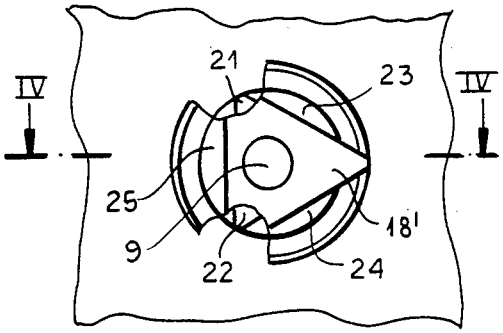
FIG. 5 is a top view, with parts broken away, of the elements shown in FIG. 4.
Figure 4:
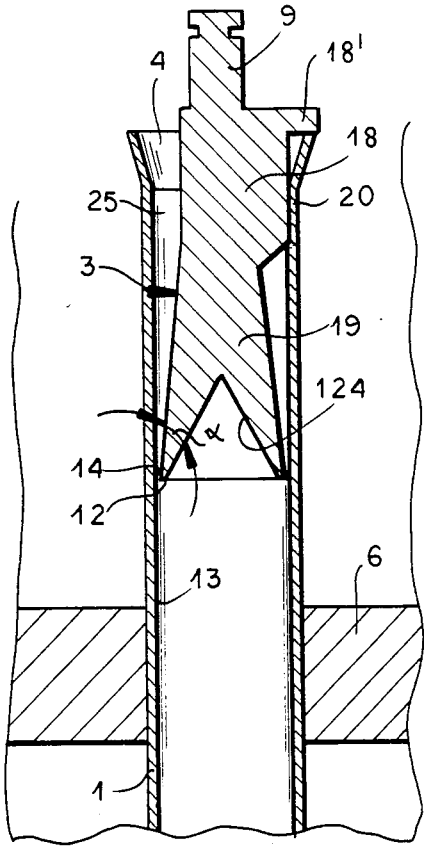
FIG. 4 is an axial sectional view, drawn to a larger scale, of an area encompassed by a circle IV in FIG. 1, showing the upper end of a heat-transfer tube and an insert reciprocable therein.

Whereas in FIGS. 4 and 5 it is assumed that the neck 9 of insert 3 is connected with cover plate 49 via a link 52 as shown in FIG. 1, I have illustrated in FIGS. 6 and 7 a direct connection between neck 9 and plate 49 with the aid of a snap ring 11.

Figure 8:
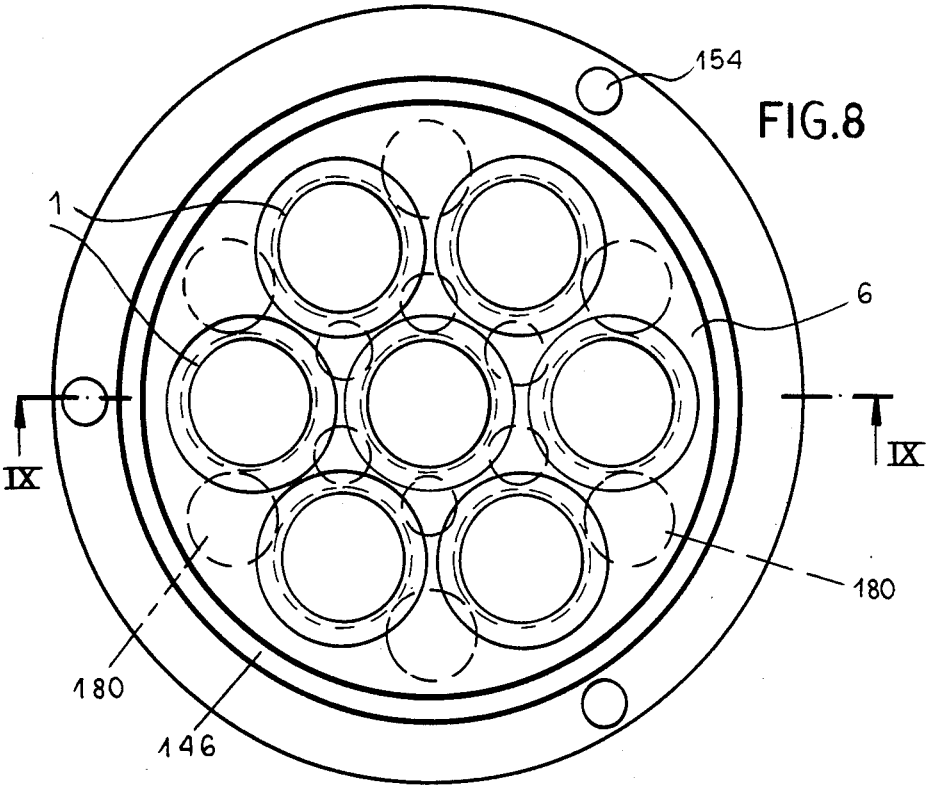
FIG. 8 is a top view, drawn to a larger scale, of a set of heat-transfer tubes projecting from a cover plate of a boiler shown in the lower part of FIG. 1.
Figure 9:
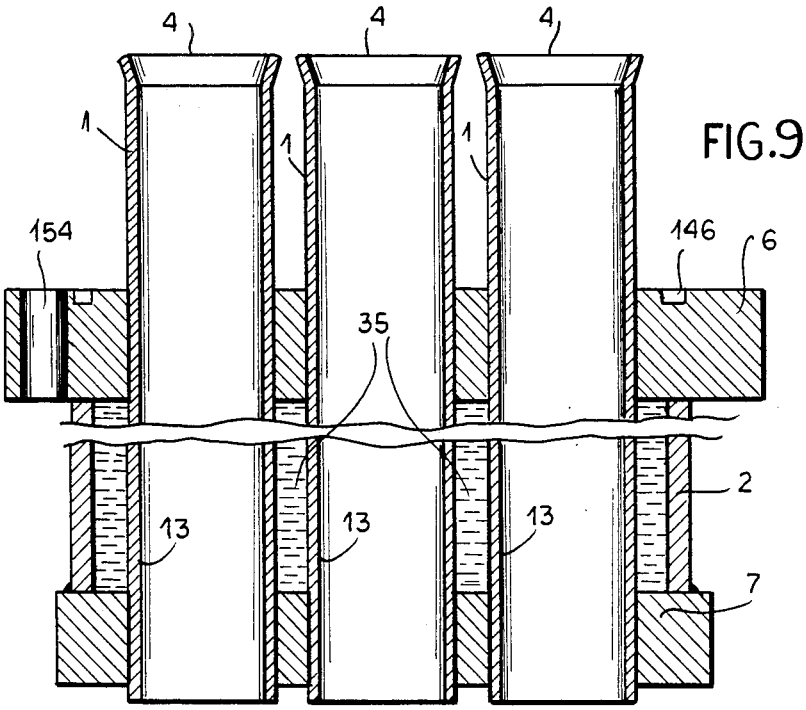
FIG. 9 is a cross-sectional view taken on the line IX—IX of FIG. 8.

FIGS. 8 and 9 show a cluster of tubes 1 with entrance ends 4 projecting above cover plate 6, the associated inserts 3 having been omitted. In order to reduce the effective volume of the boiler 2 surrounding these tubes and therefore the amount of refrigerant to be circulated therethrough, solid inert spacers 180 may be disposed in the intervening clearances as indicated in FIG. 8. These spacers could be spheres or rods, possibly hollow but with closed ends.

As further shown in FIGS. 8 and 9, cover plate 6 is provided at its upper surface with an annular groove 146 designed to receive the vessel 37 of FIGS. 1 and 2 with tight fit. The top of that vessel is overlain by a plate 150 held in position by rods 156 which are anchored in marginal apertures 154 of plate 6 and have threaded upper ends engaged by nuts 157. As seen in FIG. 3, plate 150 has the shape of a truncated equilateral triangle leaving voids 158 so as to make the interior of vessel 37 accessible to supply pipe 85. In other instances as where the contends of vessel 37 are a liquid such as milk which ought not to be contaminated, cover plate 150 may be enlarged to close the vessel.

The cylinder of jack 46, rising from plate 150, supports another plate 149 which carries two manometric switches 76 and 126 forming part of respective level sensors. One sensor further includes a riser tube 137 extending from manometric switch 126 through plates 149 and 150 into the interior of vessel 37 where it ends below the liquid level 45 under the conditions illustrated in FIG. 1. The other sensor has a similar, shorter tube 77 extending from manometric switch 76 through plates 149, 150 into vessel 37 but terminating above level 45 in the case depicted in FIG. 1. Sensors 126, 127 and 76, 77 form part of a control circuit, more fully described hereinafter with reference to FIG. 10, which also includes a pair of microswitches 64, 129 respectively responsive to rollers 62 and 131 serving as followers for a pair of cams 55, 132 on piston rod 50. The upper cam 55 is of significant vertical length exceeding its separation from the lower cam 132. Microswitches 64 and 129 are supported on plate 149 by a post 148. The control circuit including the sensors and the microswitches serves to actuate the jack 46 for the purpose of displacing the several inserts 3 under circumstances to be explained.

While the liquid 15 to be cooled descends in the several tubes 1, a volatile refrigerant 35 ascends in the boiler 2 from an entrance port 172 to a pair of exit ports 173, 174. These latter ports communicate via respective overflow conduits 161, 162 with opposite ends of a horizontal sleeve 159 spacedly disposed inside phase separator 160, this sleeve having a closed right-hand end and an open left-hand end as viewed in FIG. 1. Phase separator 160 is a cylindrical container with end walls 99 and 168 respectively confronting the closed and open ends of sleeve 159. A drain 171 delivers liquefied refrigerant from a sump 36 at the bottom of separator 160 to port 172 while a top outlet 169 supplies refrigerant vapors to a suction port of a compressor 102 working into a condenser 108 as schematically indicated in FIG. 1. The condenser, which may give up latent heat from the refrigerant to an external load, sends the reliquefied refrigerant to an injection pipe 109 which penetrates the end wall 9 and the closed end of sleeve 159, terminating in a nozzle 184 near the open end of that sleeve. The injected liquid helps entrain the partly vaporized refrigerant leaving the top of boiler 2 by way of conduits 161, 162. The vapors, aspirated by compressor 102, are drawn toward outlet 169 which is located near the opposite end wall 99; these vapors, accordingly, must traverse almost the full length of container 160 and are thus able to shed all the entrained liquid which accumulates in the sump 36 to a low level indicated at 34.

Figure 10:
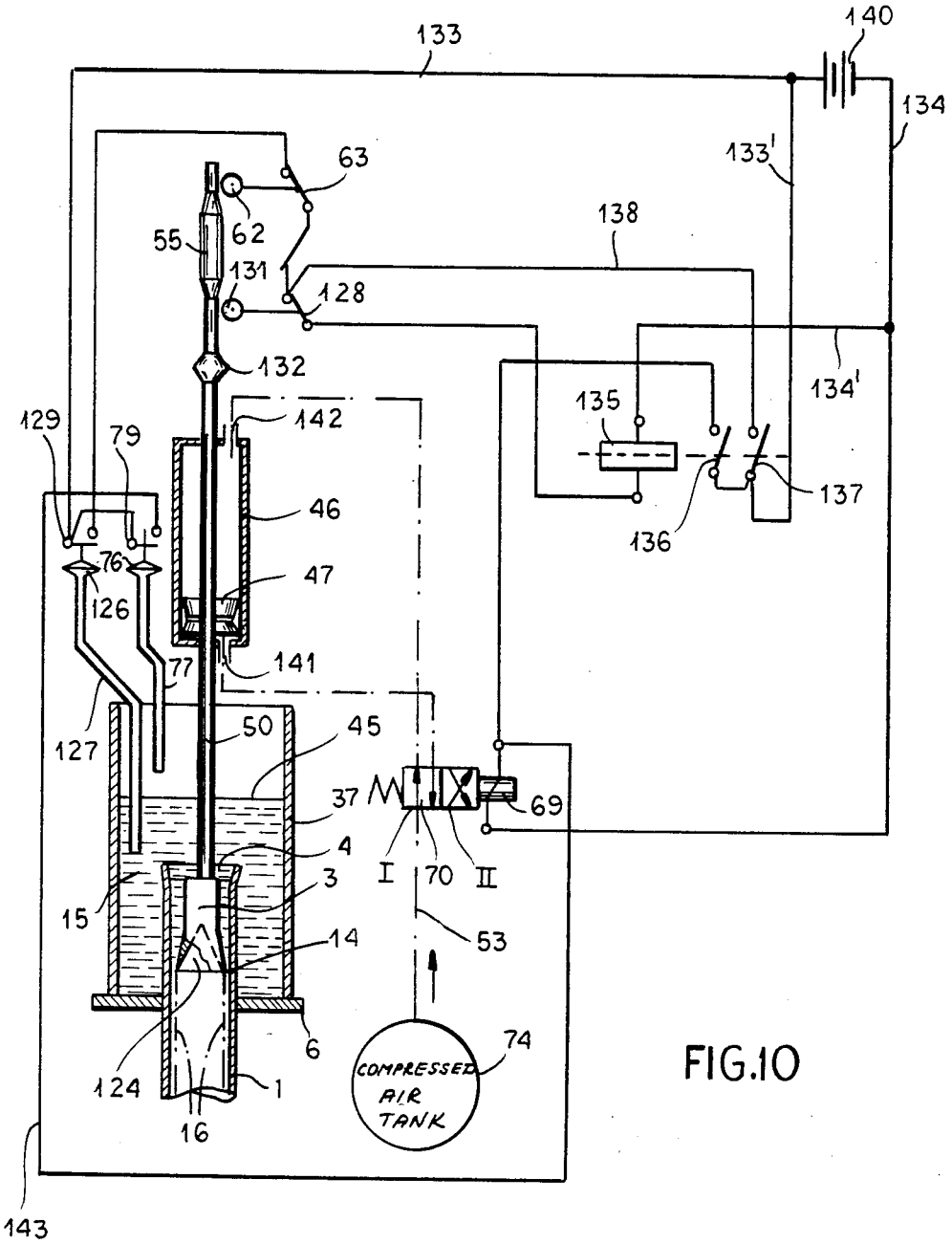
FIG. 10 is a circuit diagram of a system for automatically displacing the insert of FIG. 4 with reference to its surrounding tube.

The liquid level 45 seen in FIG. 1 may be just below a first limit at which the head of water 15 exerts enough pressure upon a membrane in manometric switch 126 (FIG. 2) to close a contact 125 thereof, FIG. 10, which is connected at one end via a lead 133 to one terminal of a current source 140 here shown as a battery. The opposite terminal of that source is connected by way of a lead 134 to a coil 69 of a 4-way solenoid valve 70 which in its illustrated position I, with coil 69 de-energized, connects a lower port 141 of jack 46 to the atmosphere while a compressed-air tank 74 is connected by way of a conduit 53 to an upper port 142 of the jack. The piston 47, 50 of the jack is therefore held in its bottom position in which insert 3, representative of a group of such inserts as shown in preceding Figures, lies well within the top portion of the associated tube 1. If, however, solids entrained by the water 15 obstruct the annular gap 14, the liquid level rises above that first limit and closes the contact 125 to establish an operating circuit for a normally deactivated relay 135 by way of serially connected closed contacts 63, 128 of microswitches 64 and 129, the winding of relay 135 and a branch 134' of lead 134. In attracting its armatures 36 and 37, relay 135 closes a holding circuit for itself via a branch 133' of lead 133, a lead 138 and microswitch contact 128 while energizing the solenoid coil 69, thereby moving valve 70 to its alternate position II in which conduit 53 is connected to lower port 141 of jack 46 whose upper port 142 is now vented to the atmosphere. This causes the piston 47, 50 to rise along with insert 3 until cams 55 and 132 successively open the associated microswitch contacts 63 and 128. At this point the holding circuit of relay 135 is broken and valve 70 returns to its position I, thereby again causing the jack 46 to lower the insert 3 to its normal level. If the single reciprocation has not yet cleared the gap 14 but lets enough water pass through that gap to prevent a further rise of liquid level 45, the same procedure is repeated. Tank 74, of course, could be replaced by a compressor.

If the gap remains clogged after one or more reciprocations of insert 3, liquid level 45 will rise above a second limit to envelop part of tube 77 until a membrane of the associated manometric switch 76 closes a previously open contact 79 connected to lead 133 in parallel with contact 125. Such closure shunts the relay armature 136 in completing an energizing circuit for solenoid coil 69 via leads 143 and 134. With valve 70 again shifted into position II, piston head 47 performs an upward stroke long enough to lift the insert 3 completely out of its tube 1. This motion momentarily eliminates the gap 14 so that any obstructing matter is able to drop through the tube 1, thus causing a rapid draining of container 37 whereby the liquid level 45 descends below the aforementioned limits to open sensor contacts 79 and 125 in succession.

With sensor contact 125 closed and sensor contact 79 open, the establishment of the holding circuit for relay 135 by its armature 137 places the release of that relay under the joint control of microswitch contacts 63 and 128. Since contact 128 invariably opens while contact 63 is still open, the resulting downstroke of piston 47, 50 is not reversed as soon as contact 128 recloses. The presence of the individually cam-controlled microswitches, therefore, avoids the rapid oscillations of the piston and of insert 3 which would occur if only a single contact 63 or 128 were utilized in the energizing circuit of relay 135.

It will be apparent that the pneumatic jack 46 could be replaced by some other servomotor, e.g. one of electric type, to be operated in an analogous manner. It is also possible to replace the relay and its microswitches by a timer periodically shifting the solenoid valve 70 between its positions I and II upon closure of sensor contact 125, the timer being deactivated to arrest the valve in its position II upon closure of sensor contact 79.

Figure 11:
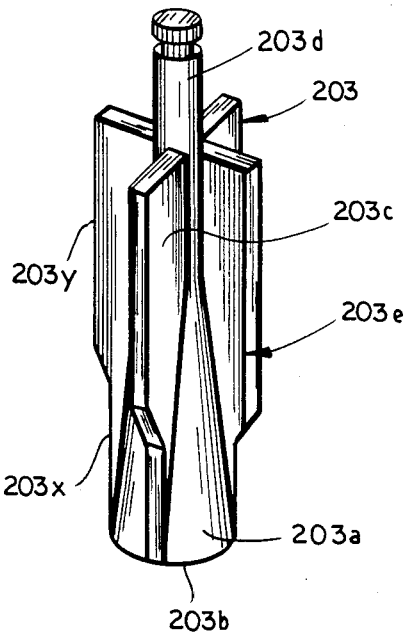
FIG. 11 is a perspective view of an insert for a heat-exchanger in accordance with another embodiment of the invention.
Figure 12:
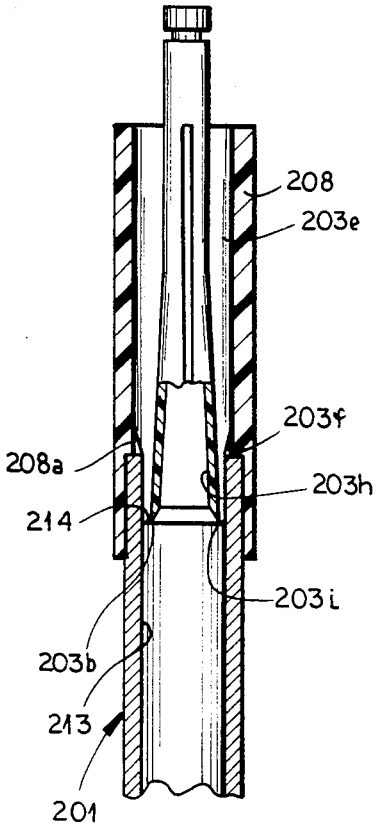
FIG. 12 is an axial cross section through a tube assembly of the latter embodiment.
Figure 13:
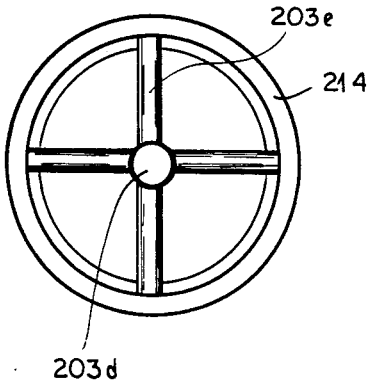
FIG. 13 is a top end view thereof.

As can be seen from FIGS. 11–13, the improved insert body 203 can have a lower frustoconical portion **203*a* whose lower edge 203*b* defines a gap 214 with the inner wall 213 of the pipe 201. The insert 203 also has, integrally with the lower portion and injection molded from synthetic resin in one piece therewith, a cylindrical shank or stem 203***c* which projects at 203*d* beyond a plurality of angularly equispaced ribs of webs 203*e* which are stepped at 203*f* to separate upper portions 203*y* which guide the insert on a sleeve 208 from lower portions 203*x* which enter the tube 201.

The inner wall of the sleeve 208 has a shoulder 208*a* which abuts the upper end of the tube 201 and provides a stop for the steps of the guide webs 203*e*. The projecting end 203*d* of the stem can have a groove 203*g* receiving a C-clip as described (FIG. 6).

The frustoconical portion 203*a* can have a downwardly open cavity 203*h* terminating in a bevel 203*i* forming the edge 203*b* at the inner side. The bevel 203*i* prevents adhesion disruption of the falling film.

While the assembly of this embodiment operates in a manner similar to that of the embodiments described in connection with FIGS. 4–6, for example, it represents a considerable structural simplification while affording greater precision in establishing the gap width.

I claim:

1. A tube assembly for a falling film heat exchanger comprising:

a metal tube;

a synthetic resin sleeve fitted snugly over said tube and formed with an inwardly extending shoulder abutting an upper end of said tube, said sleeve being open upwardly over its entire cross section;

an insert received in said sleeve and said tube and having:

a frustoconical lower portion diverging outwardly toward and within an inner wall of said tube and defining therewith a narrow annular gap from which a liquid film can pass downwardly along said inner wall of said tube, a solid cylindrical stem extending upwardly from said frustoconical lower portion, and a plurality of angularly equispaced guide webs extending radially outwardly from said stem lying in respective axial planes, said stem having a free end extending above said webs and said sleeve, said guide webs having upper portions slidably engaging an inner wall of said sleeve for accurately positioning said edge relative to said inner wall of said tube, lower portions extending into said tube, and steps respectively between each upper portion and lower portion of each guide web engaging said shoulder for limiting the penetration of the insert into said tube, said insert being integrally molded from a synthetic resin and is separate from said sleeve, said frustoconical lower portion being formed with a downwardly widening conical cavity terminating in an outwardly extending bevel defining said edge.

2. The assembly defined in claim 1, further comprising means located above a mouth of said sleeve for letting liquid flow downwardly through said sleeve and through said annular gap, said frustoconical lower portion being formed with a downwardly open recess having upwardly converging generatrices including an angle ranging between about 45° and 60°, said lower portion diverging with a vertex angle on the order of 10°, said annular gap having a width of not more than about 1 mm, means being provided for contacting a wall of said tube with a liquid refrigerant.

3. The assembly defined in claim 2 wherein said width ranges between substantially 0.3 and 0.7 mm.

4. The assembly defined in claim 2 wherein said means located above said mouth of said sleeve includes a storage vessel for said liquid, said assembly further comprising a boiler containing said liquid refrigerant and provided with a cover plate supplying said vessel.

5. The assembly defined in claim 2 wherein said insert is vertically reciprocable relative to said tube for dislodging solids entrained by said liquid accumulating in said gap.

6. The assembly defined in claim 5 wherein said liquid is continuously fed to said mouth of said sleeve at a steady rate, further comprising sensing means for detecting a rise in the level of liquid above said mouth as an indication of clogging of said gap by said solids and servo means responsive to said sensing means for reciprocating said insert within said tube until said level returns to a normal value.

7. The assembly defined in claim 6 wherein said sensing means comprises a first sensor for detecting a rise of said level above a first limit and a second sensor for detecting a further rise of said level above a second limit, said servo means being responsive to said first sensor for reciprocating said insert within said tube, said servo means being further responsive to said second sensor for completely lifting said insert out of said tube to enable a dislodgment of larger chunks of solids through said tube.

8. The combination defined in claim 6 wherein said servo means comprises a fluidic jack, a solenoid valve operable to admit pressure fluid alternately from below and from above into said jack, a relay controlling the operation of said solenoid valve, said jack having a piston rod connected with said insert, cam means on said piston rod, and switch means actuatable by said cam means to energize said relay.

9. The combination defined in claim 8 wherein the connection between said piston rod and said insert includes a universal joint.

10. The combination defined in claim 6 wherein said tube is one of several upright heat transfer tubes in said boiler provided with respective inserts jointly connected with said servo means.

11. The combination defined in claim 10, further comprising invert solid spacers disposed in said boiler between said heat-transfer tubes for reducing the volume available to said refrigerant.

* * * * *